US009752079B2

(12) United States Patent
Cullinane et al.

(10) Patent No.: US 9,752,079 B2
(45) Date of Patent: Sep. 5, 2017

(54) ELECTROSTATIC FILTRATION OF FINE SOLIDS FROM BITUMEN

(71) Applicants: John Timothy Cullinane, Montgomery, TX (US); Bhupender S. Minhas, Bridgewater, NJ (US)

(72) Inventors: John Timothy Cullinane, Montgomery, TX (US); Bhupender S. Minhas, Bridgewater, NJ (US)

(73) Assignee: ExxonMobil Upstream Research Company, Spring, TX (US)

( * ) Notice: Subject to any disclaimer, the term of this patent is extended or adjusted under 35 U.S.C. 154(b) by 29 days.

(21) Appl. No.: 14/853,018

(22) Filed: Sep. 14, 2015

(65) Prior Publication Data

US 2016/0102254 A1 Apr. 14, 2016

Related U.S. Application Data

(60) Provisional application No. 62/063,626, filed on Oct. 14, 2014.

(51) Int. Cl.
*B03C 7/00* (2006.01)
*C10G 1/04* (2006.01)
(Continued)

(52) U.S. Cl.
CPC ..... *C10G 1/045* (2013.01); *B03C 7/02* (2013.01); *C10G 1/002* (2013.01); *C10G 1/04* (2013.01); *C10G 32/02* (2013.01)

(58) Field of Classification Search
CPC .... B03C 7/00; B03C 7/02; B03C 9/00; C10G 1/04; C10G 1/002; C10G 1/045; C10G 32/02
(Continued)

(56) References Cited

U.S. PATENT DOCUMENTS 5,308,586 A 5/1994 Fritsche et al.
8,114,274 B2 2/2012 Moran et al.
(Continued)

FOREIGN PATENT DOCUMENTS

CA 2662346 A1 10/2010
WO 2011081734 A1 7/2011
WO 2013048622 A1 4/2013

OTHER PUBLICATIONS

Nikakhtari et al., "Solvent screening for non-aqueous extraction of Alberta oil sands", The Canadian Journal of Chemical Engineering, Jun. 30, 2013, pp. 1153-1160, vol. 91, No. 6, John Wiley & Sons.
(Continued)

*Primary Examiner* — Joseph C Rodriguez
*Assistant Examiner* — Kalyanavenkateshware Kumar
(74) *Attorney, Agent, or Firm* — ExxonMobil Upstream Research Company Law Department

(57) ABSTRACT

Methods are provided for removing fine particles from crude oils extracted from mined oil sands using a non-aqueous extraction solvent. A bitumen derived from non-aqueous extraction of oil from oil sands can undergo optional physical separation to remove larger particles and then processed using electrostatic filtration to remove particle fines. This can allow for production of a bitumen product from a non-aqueous extraction process that has a sufficiently low particle content to be suitable for pipeline transport.

20 Claims, 4 Drawing Sheets

(51) Int. Cl.

| | |
|---|---|
| ***C10G 1/00*** | (2006.01) |
| ***B03C 7/02*** | (2006.01) |
| ***C10G 32/02*** | (2006.01) |

(58) Field of Classification Search
USPC ..... 209/127.1; 208/308, 311, 390
See application file for complete search history.

(56) References Cited

U.S. PATENT DOCUMENTS

| | | | | |
|---|---|---|---|---|
| 2005/0197267 | A1* | 9/2005 | Zaki | C11D 1/526 510/245 |
| 2012/0000331 | A9 | 1/2012 | Moran et al. | |
| 2012/0305451 | A1* | 12/2012 | Adeyinka | C10G 1/04 208/390 |
| 2014/0021103 | A1 | 1/2014 | House et al. | |
| 2014/0042028 | A1* | 2/2014 | Sams | B03C 11/00 204/559 |

OTHER PUBLICATIONS

PCT/US2015/050120 International Search Report and Written Opinion dated Dec. 17, 2015.

* cited by examiner

ELECTROSTATIC FILTRATION OF FINE SOLIDS FROM BITUMEN

CROSS-REFERENCE TO RELATED APPLICATIONS

This application claims priority to U.S. Provisional Application Ser. No. 62/063,626 filed Oct. 14, 2014, herein incorporated by reference in its entirety.

FIELD OF THE INVENTION

This disclosure provides methods for separating fine solids from bitumen using electrostatic filtration.

BACKGROUND OF THE INVENTION

Oil sands are an increasingly important source of raw petroleum. Due to the solid nature of oil sands, extraction of crude oil from oil sands presents a variety of challenges. Some challenges are related to creating a crude oil from the oil sands that is suitable for transport via pipeline.

One option for removing the non-petroleum material is to first mix the raw product with water. For example, a water extraction process can be used to separate a majority of the non-petroleum material from the desired raw crude or bitumen. A water extraction process can remove a large proportion of the solid, non-petroleum material in the raw product. However, after the initial water extraction process, smaller particles of non-petroleum particulate solids will typically remain with the oil phase at the top of the mixture. This top oil phase is sometimes referred to as a froth. Separation of the smaller non-petroleum particulate solids can be achieved by adding an additional solvent to the froth of the aqueous mixture. This is referred to as a "froth treatment". For example, a paraffinic solvent such as heptane can be added to the froth to cause a phase separation between an aqueous based phase and a bitumen phase. Unfortunately, due to the nature of the paraffinic solvent, a portion of the potential petroleum product is lost with the aqueous phase. The petroleum product lost with the aqueous phase may include a substantial portion of asphaltenes.

As an alternative to a water extraction, a non-aqueous extraction can be performed to separate crude oil from oil sands. Use of a non-aqueous extraction solvent can reduce or minimize the amount of water needed for extraction of crude oil from oil sands, and can potentially eliminate the need to perform a subsequent froth treatment. However, use of a non-aqueous extraction solvent can increase the amount of fine particulate matter that remains in the bitumen phase. The presence of an elevated content of fine particulate matter can create difficulties when attempting to transport such a non-aqueous extracted crude oil via pipeline.

U.S. Pat. No. 8,114,274 describes a method for treating bitumen froth with high bitumen recovery and dual quality bitumen production. The method includes using multiple gravity settling steps to separate phases containing bitumen in a hydrocarbon diluent from phases containing water, fine solids, and residual bitumen. Naphtha is provided as an example of a hydrocarbon diluent. One described advantage of the method is generation of a lighter bitumen stream that is suitable for transport by pipeline without further processing.

U.S. Published Patent Application 2012/0000831 describes methods for separating out a solvent feed after use in recovery of bitumen from oil sands. The method includes treating a bitumen froth with a paraffinic or naphthenic type diluent to produce bitumen and froth treatment tailings. Toluene is identified as a naphthenic type diluent that can improve bitumen recovery from tailings.

U.S. Published Patent Application 2014/0021103 describes methods for extracting bitumen from an oil sand stream. The method includes contacting the oil sand stream with a non-aqueous solvent and then screening the combined oil sand and solvent stream to form a screened oil sand stream and a rejects stream. Bitumen is then extracted from the screened oil sand stream.

U.S. Pat. No. 5,308,586 describes an electrostatic separator using a bead bed. The separator is described as being suitable for separating FCC catalyst fines from an FCC slurry oil. The electrostatic separator is periodically backflushed with additional treated slurry oil to remove particles from the separator. These backflushed particles are returned to the FCC reactor.

SUMMARY OF THE INVENTION

In an aspect, a method is provided for producing a bitumen product from oil sands, including extracting bitumen from oil sands with a non-aqueous extraction solvent to form a mixture of bitumen and extraction solvent; performing a physical separation on at least a portion of the mixture of bitumen and extraction solvent to form at least a first filtered mixture of bitumen and extraction solvent; separating at least a portion of the first filtered mixture of bitumen and extraction solvent to form a filtered bitumen stream and a filtered extraction solvent stream, the filtered bitumen stream containing at least about 0.25 wt % of non-petroleum particles; and performing an electrostatic separation on at least a portion of the filtered bitumen stream to form a bitumen product containing about 1200 wppm or less of non-petroleum particles. Optionally, the method can further include diluting the bitumen product with a diluent, the diluent being different from the extraction solvent.

In some aspects, performing an electrostatic separation on at least a portion of the filtered bitumen stream can include passing the at least a portion of the filtered bitumen stream into a separation volume of an electrostatic separator under effective electrostatic separation conditions, the effective electrostatic separation conditions including maintaining a separation voltage across the separation volume, at least a portion of the separation volume optionally containing a solid dielectric material; purging the separation volume with a purge fluid to form a purged portion of the bitumen product; and washing the separation volume with the extraction solvent, a washing voltage across the separation volume during the washing being less than the separation voltage.

In another aspect, a method is provided for producing a bitumen product from oil sands, including extracting bitumen from oil sands with a non-aqueous extraction solvent to form a mixture of bitumen and extraction solvent; performing a physical separation on at least a portion of the mixture of bitumen and extraction solvent to form at least a first filtered mixture of bitumen and extraction solvent, the first filtered mixture of bitumen and extraction solvent containing at least about 0.25 wt % of non-petroleum particles; performing an electrostatic separation on at least a portion of the first filtered mixture of bitumen and extraction solvent to form a filtered, separated mixture of bitumen and extraction solvent; and separating at least a portion of the filtered, separated mixture of bitumen and extraction solvent to form a bitumen product and an extraction solvent stream, the bitumen product containing about 1200 wppm or less of non-petroleum particles. Optionally, the method can further include diluting the bitumen product with a diluent, the diluent being different from the extraction solvent.

In some aspects, performing an electrostatic separation on at least a portion of the first filtered mixture of bitumen and extraction solvent can include passing the at least a portion of the first filtered mixture of bitumen and extraction solvent into a separation volume of an electrostatic separator under effective electrostatic separation conditions, the effective electrostatic separation conditions including maintaining a separation voltage across the separation volume, at least a portion of the separation volume optionally containing a solid dielectric material; purging the separation volume with a purge fluid to form a purged portion of the filtered, separated mixture of bitumen and extraction solvent; and washing the separation volume with the extraction solvent, a washing voltage across the separation volume during the washing being less than the separation voltage.

DETAILED DESCRIPTION OF THE INVENTION

Overview

Figure 1:
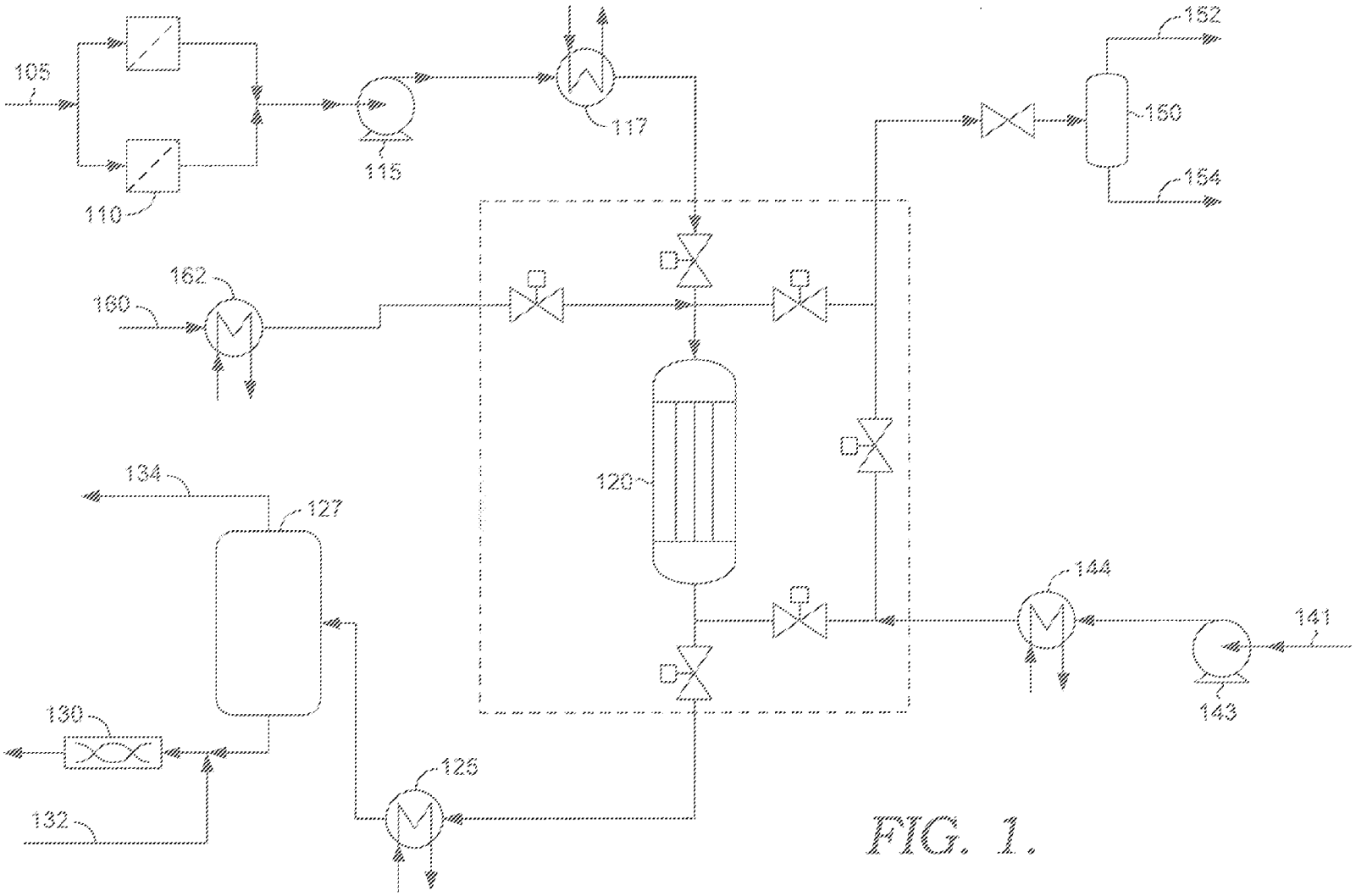
FIG. 1 schematically shows an example of a process flow for operating an electrostatic separator.

In various aspects, methods are provided for removing fine particles from crude oils extracted from mined oil sands using a non-aqueous extraction solvent. A bitumen derived from non-aqueous extraction of oil from oil sands can be filtered and then processed using electrostatic filtration to remove particle fines. This can allow for production of a bitumen product from a non-aqueous extraction process that has a sufficiently low particle content to be suitable for pipeline transport. This is in contrast to conventional methods for reducing the particle content in a crude oil formed using non-aqueous extraction. For example, one conventional option can be to add water after the non-aqueous extraction and then perform a paraffinic froth treatment. While this can be effective, a portion of the benefit of performing a non-aqueous extraction can be lost due to the need to add water and/or due to the potential loss of asphaltenes in the froth treatment.

In various aspects, methods for performing the electrostatic separation process are also provided. Due to the potentially large weight percentage of particles in a bitumen derived from a non-aqueous extraction process, the time required for regeneration (backwash) of the electrostatic precipitator can be comparable to the time spent removing particles from the bitumen. Operating the electrostatic precipitation process in an improved manner can reduce or minimize the amount of bitumen lost. In some aspects, this can include the use of inert purge streams, such as nitrogen or air, that can be used to purge bitumen with reduced particle content into the product output flow. Due to the high frequency of regeneration, the volume of reduced particle bitumen present in the electrostatic separator at the end of a particle removal step can be substantial relative to the total amount of reduced particle bitumen product. Use of an inert purge stream can allow this additional product to be added to the total product from the separation system. This is in contrast to a conventional method of operation for the electrostatic separator, where at the end of a separation step any remaining product in the separator would be recycled along with the wash fluid for regenerating the separator.

In this discussion, a non-aqueous extraction solvent is defined as a solvent where a) the water content of the solvent is less than 10 wt %, or less than 5 wt/o, and preferably less than 3 wt %, or less than 1 wt % and b) water is not present in the solvent as a distinct phase prior to mixing the non-aqueous extraction solvent with oil sands to extract bitumen. It is noted that addition of a non-aqueous extraction solvent to oil sands to extract bitumen may or may not result in formation of a separate water phase.

Generating Bitumen from Oil Sands

Oil sands often require some further processing at the mine site to allow for transport of the resulting crude oil. For example, during mining of oil sands, a portion of non-petroleum solid particulate material (such as sand) typically remains in the mined oil sands after removal from the earth. A water extraction process can be used to separate a majority of the non-petroleum material from the desired raw crude or bitumen. A hot water or cold water extraction process is an example of a process for mixing water with oil sands to extract the raw crude. Air is typically bubbled through the water to assist in separating the bitumen from the non-petroleum material. A water extraction process can remove a large proportion of the solid, non-petroleum material in the raw product. However, after the initial water extraction process, smaller particles of non-petroleum particulate solids will typically remain with the oil phase at the top of the mixture. This top oil phase is sometimes referred to as a froth.

Removal of solids from the froth phase can be enhanced by adding an additional solvent to the bitumen. One example of a suitable additional solvent is a paraffinic type solvent, such as pentane, isopentane, or another alkane (or mixture of alkanes) containing 5 to 8 carbon atoms. Adding the paraffinic solvent results in a two phase mixture, with the crude and the paraffinic solvent forming one of the phases. The smaller particulate solids of non-petroleum material are "rejected" from the oil phase and join an aqueous phase. Unfortunately, a substantial portion of the asphaltenes present in the froth (such as 40%-55%) also typically enter the water phase due to addition of the paraffinic type solvent. The crude oil and solvent phase can then be separated from the aqueous phase, followed by optional recovery of the paraffinic solvent for recycling. The froth treated crude oil is typically mixed with a lower viscosity material, such as naphtha or kerosene, to produce an overall mixture that is suitable for pipeline transport. Unfortunately, the crude oil resulting from such a froth treatment process is typically not suitable for making commercially desirable grades of asphalt, due to the loss of the asphaltenes. Additionally, the loss of asphaltenes and/or other compounds due to rejection in the paraffinic froth treatment can be as much as a 10% reduction in yield.

An alternative to water based extraction of crude oil from oil sands is to use a non-aqueous extraction process. Instead of initially treating the oil sands with water as a solvent, the oil sands can be treated with an organic solvent and bitumen to separate the crude oil from the non-petroleum matter. Suitable organic solvents can be solvents that reduce or minimize the loss of bitumen due to a lack of solubility while also being separable from the bitumen so that the solvent can be substantially recycled. Cyclohexane is an example of a suitable solvent that can be substantially separated from bitumen using a flash or distillation process while still providing sufficient solubility to retain asphaltenes and other difficult to solubilize components of the bitumen. Other suitable extraction solvents can include solvents with a boiling point in the naphtha boiling range. The naphtha boiling range can correspond to about 100° F. (37° C.) to about 350° F. (177° C.). Examples of suitable extraction solvents can include naphtha streams, heptane, other alkanes containing at least 7 carbons, cyclohexane, other cycloalkanes containing at least 6 carbons, aromatics such as toluene, or combinations thereof.

In a non-aqueous extraction process, a reduced amount of water can be used relative to an aqueous extraction process. The reduced amount of water can be used to agglomerate particles to assist in separating sand from the solvent and bitumen mixture, so that the particles can be separated from the bitumen and solvent by filtration. However, this water addition is not fully effective at agglomerating the fine particles in the solvent and bitumen mixture. As a result, the filtered bitumen and solvent can still include a substantial portion of sand and/or other non-petroleum particles. For example, the particle content of the filtered bitumen (excluding any weight of extraction solvent) can be about 0.25 wt % to about 3% or possibly higher, or about 0.25 wt % to about 2 wt %, or about 0.5 wt % to about 2 wt %, or about 0.25 wt % to about 1 wt %, or about 0.5 wt % to about 1 wt %. These particles have an average particle size of about 50 microns or less, and therefore cannot be readily removed from the bitumen by filtration.

The typical specification for transporting crude oil via pipeline is to have a solids content of 300 wppm or less. This is more than an order of magnitude lower than the expected solids content in a bitumen after a conventional non-aqueous extraction process. As a result, the conventional solution for converting a non-aqueous extraction bitumen into a suitable product for pipeline transport is to blend the non-aqueous extraction bitumen with a substantial portion of a bitumen derived from another process, such as a paraffinic froth treatment. This severely limits the ability to use non-aqueous extraction methods for production of bitumen from oil sands. Alternatively, additional water could be added to a non-aqueous extracted bitumen followed by performing a paraffinic froth treatment, but this can reduce or minimize the advantages of performing a non-aqueous extraction as compared with simply performing an aqueous extraction.

In various aspects, the particle content of a bitumen produced by non-aqueous extraction can be substantially reduced by using electrostatic filtration to separate particles from the bitumen. This can reduce, minimize, or even eliminate the need to mix the bitumen from a non-aqueous extraction process with a paraffinic froth treated bitumen prior to transport by pipeline. Using electrostatic filtration for particle removal from a bitumen derived from non-aqueous extraction can allow for recovery of oil from mined oil sands with reduced or minimized losses of oil, such as having a yield loss of about 1 wt % due to the non-aqueous extraction and electrostatic precipitation process. This is in contrast to the potential 10% yield loss from paraffinic froth treatment. Additionally, the non-aqueous extraction bitumen is also believed to retain sufficient asphaltenes to be suitable for forming various grades of asphalt.

Filtration and Backwash Cycle

In an electrostatic separator, an oil stream containing particles can be passed into the separator. An interior volume or separation volume of the separator can contain a bed of glass beads or other dielectric (insulating) particles. During a separation process, an electric field can be maintained across the bed and/or the separation volume. This results in a spatially varying electric field due to the dielectric character of the beads. As the oil stream passes through the beads, particles become associated with the beads and are removed from the oil stream. U.S. Pat. No. 5,308,536 shows an example of an electrostatic filtration device. In U.S. Pat. No. 5,308,536, the separator is described for use in filtering a fluid catalytic cracking (FCC) slurry oil.

In this discussion, electrostatic separation is defined as a filtration process that captures fine particles according to electrostatic principles and produces a clean (reduced particle content) bitumen product stream. In this definition, the separation is performed by applying power to electrodes that are separated by a dielectric medium, creating a potential difference between the electrodes. Process fluid flows through the resulting electric field. Small particles assume a charge and are attracted to and adsorbed by the dielectric medium.

After electrostatic separation has been performed for a period of time, a sufficient amount of particles can be held in the dielectric bed so that some type of regeneration is needed. This is typically performed using a backwash. During a backwash step, the electric field across the dielectric bed is turned off while a wash solvent is passed through separator. In U.S. Pat. No. 5,308,536, the "solvent" used during the backwash is a portion of the filtered slurry oil that has a low content of the catalyst fines. The backwash is then returned to the FCC process, where the catalyst fines can contribute to the total catalyst present in the FCC reactor.

The concentration of particles in an FCC slurry oil is typically on the order of about 1000 wppm or less. Based on the concentration of particles in a typical FCC slurry oil, the volume of oil that can be processed for particle removal prior to needing a backwash is large relative to the liquid volume in the electrostatic separator. For example, a typical cycle time for particle removal from an FCC slurry oil could be to operate the electrostatic separator for an hour, followed by a 5 minute backwash. This means that the backwash corresponds to less than about 10% of the total cycle time for the separation process. As a result, the volume of the backwash is small relative to the total volume processed by the separator, so if the backwash results in recycle of some of the separated oil back to the initial feed, the loss of product volume is a small percentage of the total.

Performing electrostatic separation for particle removal for a bitumen formed from non-aqueous extraction presents a different type of situation. The particle concentration in the non-aqueous extraction bitumen can be roughly ten times greater than the particle concentration in an FCC slurry oil, such as on the order of 1 wt % or 2 wt %. For a given electrostatic separator configuration, this means that the amount of feed that can be processed prior to a wash cycle is reduced by a factor of ten relative to an FCC slurry oil. As noted above, an example of a total process cycle for an FCC slurry oil can be about 60 minutes of processing and 5 minutes of backwash. Due to the factor of ten increase in the concentration of particles in a bitumen derived from a non-aqueous extraction process, the cycle time can be closer to 10 minutes (or less) of processing and 5 minutes of washing. This means that the time for processing a feed to remove particles is comparable to the time required for washing the separation volume and/or the dielectric medium.

In aspects where the processing time and the wash (or regeneration) time are similar, the yield of low particle bitumen generated from the separator can be substantially impacted by how a wash cycle is operated. For example, if feed that is already processed to remove particles is used for the wash step, the resulting yield from the separation can be substantially lowered. The problem of maintaining a high yield is further complicated by the relative velocity of the bitumen feed through the separator. At the expected flow velocities for achieving particle removal to a desirable level, the volume of feed that can be processed during a short processing time, such as about 5 minutes to about 10 minutes, is comparable to the available liquid volume in the separation volume of the separator. This means that a substantial portion of the total potential yield of reduced particle bitumen may be contained within the separation volume when it is time to start the wash portion of the cycle.

In order to overcome these difficulties, an improved total process cycle has been developed for operating the electrostatic separator. The process cycle includes several features to improve the yield of bitumen with low solids content. One feature is related to purging of the separator prior to (and optionally after) a wash process. Instead of allowing the bitumen in the separation volume at the beginning of a wash cycle to become part of a wash effluent, the separation volume can be purged prior to starting the wash process. This purged portion of the bitumen can be added to the bitumen product as part of the bitumen product yield from the separation process. Any convenient purge fluid can be used so long as the purge fluid is separable from the desired bitumen product. One example of a suitable purge fluid is nitrogen. Other purge fluids can be inert fluids, such as methane, or compatible liquids with the bitumen product, such as condensate. If the purge fluid is a gas, the voltage across the separation volume can be reduced or turned off during the purge in order to prevent dielectric breakdown (creating a short) during the purge. After the purge, the wash can be performed. Optionally, second purge can then be used to prevent the wash solvent from entering the bitumen product.

A second feature of the improved process cycle can be to use a wash solvent that does not include the bitumen product. Instead, the wash solvent can be the extraction solvent used for the non-aqueous extraction process. Using the extraction solvent as the wash solvent can provide various advantages. For example, using the bitumen product as a portion of the wash solvent represents a potential loss in yield, as using the bitumen as the wash solvent would restore the problem that has just been solved. Additionally, the process flow for performing a non-aqueous extraction can include a dryer or other separation stage(s) for recovering extraction solvent that is lost to the water and particle mixture after extraction. By using the same extraction solvent as the wash solvent, the drier for recovery of the extraction solvent can also be used for recovering the wash solvent from any particles removed from the separation volume during a wash cycle.

When using the extraction solvent for the wash step, both the separation and the wash can be performed at a sufficient pressure to maintain the extraction solvent in a liquid state during the wash step. During separation, the electrostatic separator can be operated at a temperature of about 15° C. to about 200° C., such as about 25° C. to about 200° C. In order to maintain this temperature within the separation volume, the wash can be performed at substantially the same temperature as the temperature during electrostatic separation. For example, the temperature during a wash step can be within about 10° C. of the electrostatic separation temperature, or within about 5° C.

In some aspects, the desired temperature during a wash step can be sufficiently high so that an extraction solvent, such as cyclohexane, would normally be a gas at the wash temperature. In such aspects, the liquid state of the extraction solvent can be maintained by performing the wash at a sufficient pressure. Maintaining the separator (or the separation volume) at the sufficient pressure during both separation and wash steps can simplify the operation of the separator. In various aspects, the electrostatic separator can be operated at a pressure of about 100 kPaa to about 3500 kPaa, with pressures of about 500 kPaa to about 1500 kPaa being suitable when an elevated pressure is desired to maintain a liquid state for an extraction solvent. For example, the electrostatic separator can be operated at a pressure of about 100 kPaa to about 3500 kPaa, or about 100 kPaa to about 3000 kPaa, or about 100 kPaa to about 2500 kPaa, or about 100 kPaa to about 2000 kPaa, or about 100 kPaa to about 1500 kPaa, or about 100 kPaa to about 1000 kPaa, or about 100 kPaa to about 500 kPaa, or about 250 kPaa to about 3500 kPaa, or about 250 kPaa to about 3000 kPaa, or about 250 kPaa to about 2500 kPaa, or about 250 kPaa to about 2000 kPaa, or about 250 kPaa to about 1500 kPaa, or about 250 kPaa to about 1000 kPaa, or about 250 kPaa to about 500 kPaa, or about 500 kPaa to about 3500 kPaa, or about 500 kPaa to about 3000 kPaa, or about 500 kPaa to about 2500 kPaa, or about 500 kPaa to about 2000 kPaa, or about 500 kPaa to about 1500 kPaa, or about 500 kPaa to about 1000 kPaa.

Performing an electrostatic separation on a bitumen stream can be effective for reducing the non-petroleum particle content of the bitumen product to a desired level. For example, a bitumen stream after any optional physical separation of non-petroleum particles and prior to electrostatic separation can have a non-petroleum particle content of at least about 2500 wppm, or at least about 4000 wppm, or at least about 5000 wppm, or at least about 7500 wppm, or at least about 10000 wppm, and optionally up to about 30000 wppm or more. It is noted that the electrostatic separation can optionally be performed on a mixture of bitumen and extraction solvent. In such an optional aspect, the non-petroleum particle content of the mixture of bitumen and extraction solvent can correspond to any of the amounts noted above. After electrostatic separation, the bitumen product can have a non-petroleum particle content of about 1200 wppm or less, or about 1000 wppm or less, or about 750 wppm or less, or about 500 wppm or less.

Prior to electrostatic separation, it can be beneficial to perform a physical separation on a bitumen stream that contains particles. Examples of physical separation methods include filtering (such as passing through a filter or mesh), gravity settling, and centrifuging of a bitumen stream. Performing a physical separation can be effective for removing a portion of the larger particles in a bitumen stream prior to passing the stream into an electrostatic separator.

The operation of an electrostatic separator for removing particles from a bitumen derived from non-aqueous extraction (NAE) can be represented by a simplified process flowsheet, such as the process flowsheet shown in FIG. 1. In the process flow shown in FIG. 1, bitumen 105 from an NAE solvent recovery unit is available at a hot temperature, such as about 200° C. The bitumen can be passed through a coarse filter 110, such as a filter having openings with a size of at least about 1000 m, for physical separation of any large particles that are still present in the bitumen. This can assist with preventing plugging of the electrostatic separator(s) 120. The bitumen permeate flow from the coarse filter 110 can then optionally have its pressure increased to 500-1000 kPa prior to entering electrostatic separator 120, such as by using a pump 115. The process and wash temperatures during operation of the electrostatic separator 120 can be within 10° C., so that the temperature of the separation volume within the separator is maintained during the wash procedure. Therefore, the operating pressure can be sufficient to keep the wash solvent in liquid phase at process fluid temperatures. After the bitumen pump 115, the bitumen may be cooled 117 to an appropriate operating temperature for the electrostatic filtration step, such as about 25° C. to about 200° C.

After exiting from the electrostatic separator 120, the clean (reduced particle content) bitumen product may be cooled 125 and the pressure reduced 127 to stabilize the clean bitumen product prior to mixing 130 with a diluent 132 for pipeline transport. Vapor 134 released during stabilization (comprised primarily of residual solvent and nitrogen) can be sent to the vapor recovery unit of the NAE process. Suitable diluents can correspond to diluents in the naphtha boiling range or the kerosene boiling range. The kerosene boiling range corresponds to about 300° F. (149° C.) to about 550° F. (288° C.).

Over time, the filter (electrostatic separator 120) can reach a desired level of captured non-petroleum particles, such as any convenient amount up to the maximum capacity of the dielectric bed (filtration medium) for capturing and retaining solids. The filter can be regenerated by flushing with a wash solvent 141. The wash solvent 141 is pumped 143 and heated 144 to the operating conditions of the filter. As it flows over the filtration medium in electrostatic separator 120, the power to the filter is turned off, releasing captured particles into the backwash stream. Turning the power to the filter off corresponds to having a voltage of 0 across the filtration medium, or alternatively to having whatever residual voltage is present after power to the electrode(s) for generating the voltage across the filtration medium is removed. The wash slurry pressure is then reduced, flashing 150 a large amount of solvent. The flashed or vaporized solvent 152 (containing some purge fluid) can be sent to the NAE vapor recovery unit of the NAE process. The concentrated slurry liquid can be sent to either an NAE solids dryer 154 or an NAE primary filtration/filter wash.

The separation volume in the filter unit (electrostatic separator 120) can have a significant available liquid volume/liquid inventory. To avoid excessive product and solvent loss, a fluid can be used to purge liquid from the separation volume of the filter unit between filtration and wash steps. In the example system shown in FIG. 1, nitrogen 160 is the purge fluid due to its ease of separation from the bitumen product and its compatibility and use in other parts of the process. Alternatively, any convenient inert fluid could be used (e.g., methane, condensate). The fluid can be heated 162 to process temperature to avoid thermal swings in the unit.

The sequence of operation for a configuration such as FIG. 1 can be as follows: Process fluid (bitumen containing non-petroleum particulate solids) is passed through the separation volume of the filter with voltage creating an electrostatic field across the bed of the filter. The process flow to the unit is then stopped, and hot, dry nitrogen is used to push liquid product (clean bitumen) out of the filter. The voltage may be lowered or stopped during the nitrogen purge to prevent arcing. The nitrogen flow is then stopped as the voltage is turned off or remains off, and a wash of a hot solvent is initiated. The wash conditions can release captured particles. After the wash flow is stopped, a hot nitrogen purge flow can purge solvent from the filter. The process fluid flow (bitumen containing non-petroleum particulate solids) can then be re-started and the voltage can be turned on.

It is noted that the configuration in FIG. 1 schematically shows the electrostatic separator as one unit. More generally, a plurality of electrostatic separators can be used, with at least some of the units operating in parallel. Operating separators in parallel can allow a relatively constant flow of the particle-containing bitumen and/or the wash solvent to be maintained. In some aspects, two sets of electrostatic separators can be operated in parallel, so that a first set of separators processes the bitumen while a second set is being washed or regenerated. In other aspects, three sets of electrostatic separators can operate in parallel, if additional time is needed after washing to return the separators back to a ready condition for performing a separation. Still other convenient combinations of units operating as a group and/or in parallel can be used in order to process a desired volume of bitumen and/or to maintain continuous process operation.

Particle Removal for Bitumen Derived by Non-Aqueous Extraction

Figure 2:
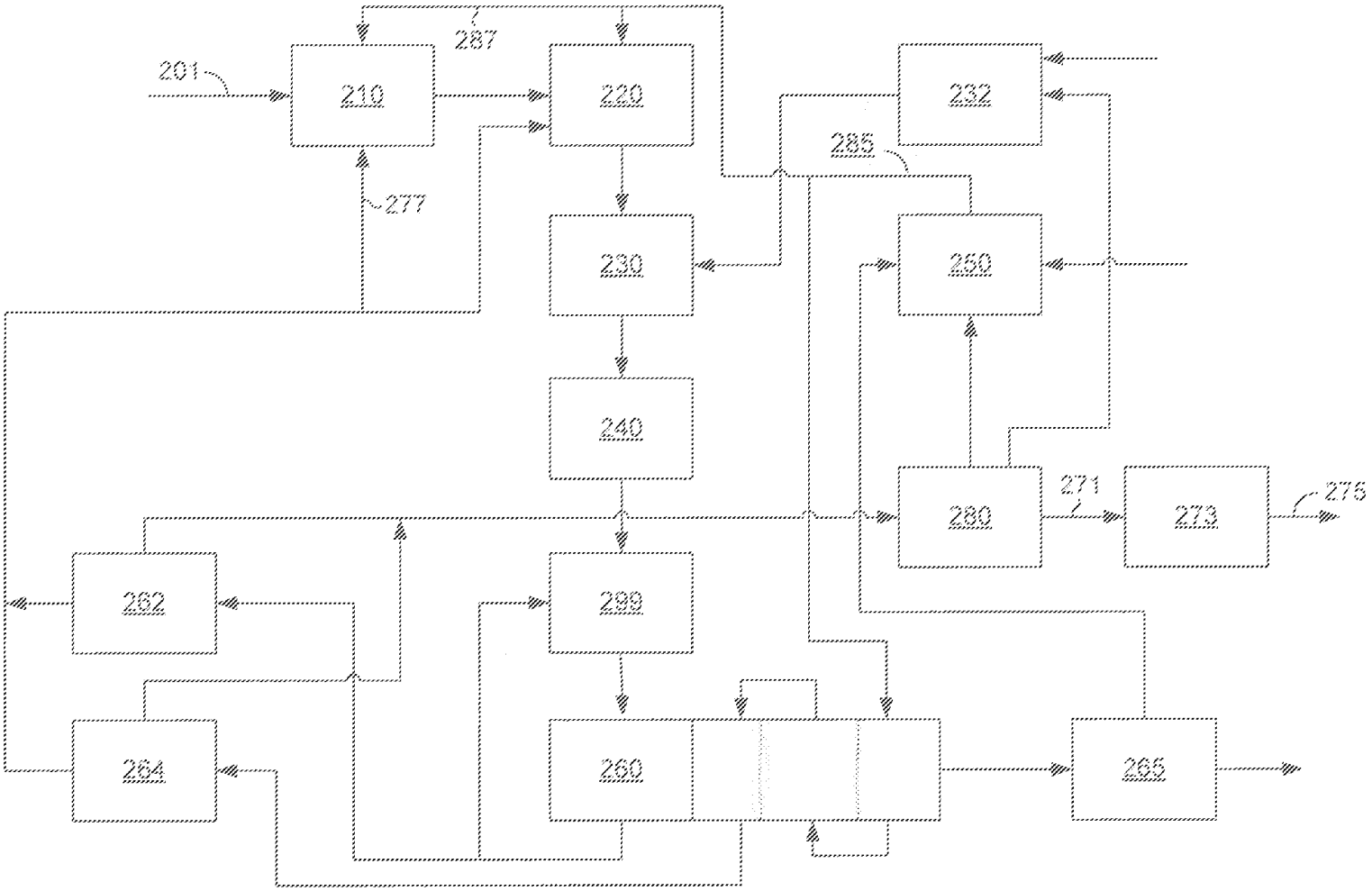
FIG. 2 schematically shows an example of a process flow for using non-aqueous extraction to form a bitumen from oil sands.

FIG. 2 shows a conventional configuration for separating particles from bitumen produced by non-aqueous extraction. In FIG. 2, raw ore 201 is fed to an ablation process 210 where it is crushed to increase exposed surface area. During ablation process 210, the ore is combined with a mixture 277 of bitumen and solvent recycled from the downstream filtration and/or solvent 287 from the solvent tank. After ablation, the slurry is fed to a dissolution step 220, which provides residence time and mixing with the solvent/bitumen mixture. Bitumen on the oil sand is extracted by dissolution into the bitumen/solvent mixture. The slurry is then fed to a water addition process 230, where water 232 is added for fine particle agglomeration 240. The resulting slurry is filtered 260 (or otherwise physically separated) to remove solids from the solvent. Prior to filtration 260 (or other physical separation), the slurry may pass through surge tanks 299 that can assist with regulating the flow delivered to the filtration unit. The solid cake is washed and dried, such as in a dryer/vapor recovery stage 265, prior to discharge from the process. The filtrate from the wash, either rich filtrate 262 from the primary filtration process or lean filtrate 264 from cleaning of the filter, contains solvent and bitumen. A portion of rich filtrate 262 and/or lean filtrate 264 mixture is recycled to the ablation 210 and dissolution 220 steps to form the initial solvent. The balance can be sent to a solvent recovery unit 280. The solvent recovery unit 280 thermally separates solvent from bitumen. The neat solvent 285 is passed into solvent tank 250 for recycling 287 to the ablation and dissolution steps. The bitumen 271 is removed from the process as product. For example, the bitumen can be mixed 273 with a diluent (such as a naphtha, kerosene, or diesel stream) to form a "dilbit" product 275 that is suitable for pipeline transport.

The conventional configuration shown in FIG. 2 results in a dilbit product with a particle content that is too high for pipeline transport. An electrostatic separation or filtration stage can be used to further reduce the particle content to a desired level. In various aspects, the electrostatic filtration stage can be integrated with the non-aqueous extraction process to provide, for example, an improved yield of bitumen relative to a conventional use of a filtration stage. For a conventional configuration, such as the configuration used for filtration of FCC catalyst fines in U.S. Pat. No. 5,308,586, the electrostatic filtration stage is backwashed with the final product. That would correspond to using either the filtered bitumen or the dilbit as the backwash solvent, resulting in a substantial loss of yield. Instead of this conventional configuration, in various aspects the solvent from the non-aqueous extraction can be used, such as cyclohexane. In addition to improving the yield of bitumen, the use of the solvent from the non-aqueous extraction can allow the backwash process to be integrated with the other elements of the non-aqueous extraction system.

Figure 3:
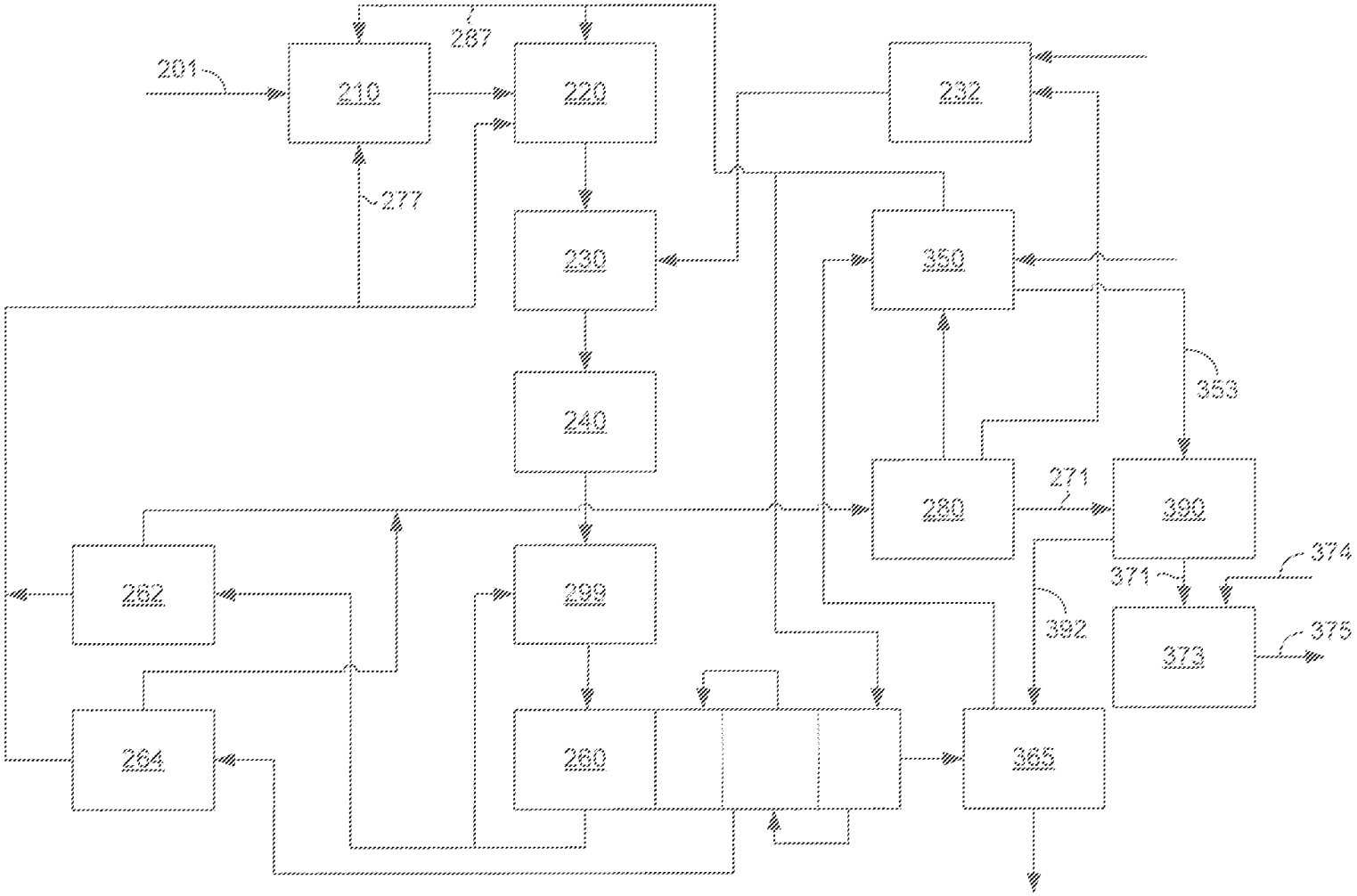
FIG. 3 schematically shows an example of a process flow for using non-aqueous extraction to form a bitumen from oil sands.

FIG. 3 shows an example of improved integration of electrostatic filtration with a non-aqueous extraction system. In FIG. 3, an electrostatic filtration stage 390 is used to remove particles from the bitumen 371 after solvent recovery 280 but prior to mixing 373 the bitumen with diluent 374 to form the dilbit product 375. In a configuration similar to FIG. 3, when the electrostatic separator(s) 390 is purged with nitrogen at the end of the particle removal step, the additional bitumen product removed from the separation volume by the nitrogen purge can be added to the bitumen product 371 that is mixed 373 with the diluent to form the dilbit product. After the nitrogen purge, a wash is performed using a non-aqueous solvent stream 353 from solvent tank 350. After passing through the electrostatic separation stage 390, the wash effluent 392 can contain the particles released by the electrostatic filters. The wash effluent 392 can be passed into the dryer/vapor recovery stage 365 for separation of the solvent from the particles.

Figure 4:
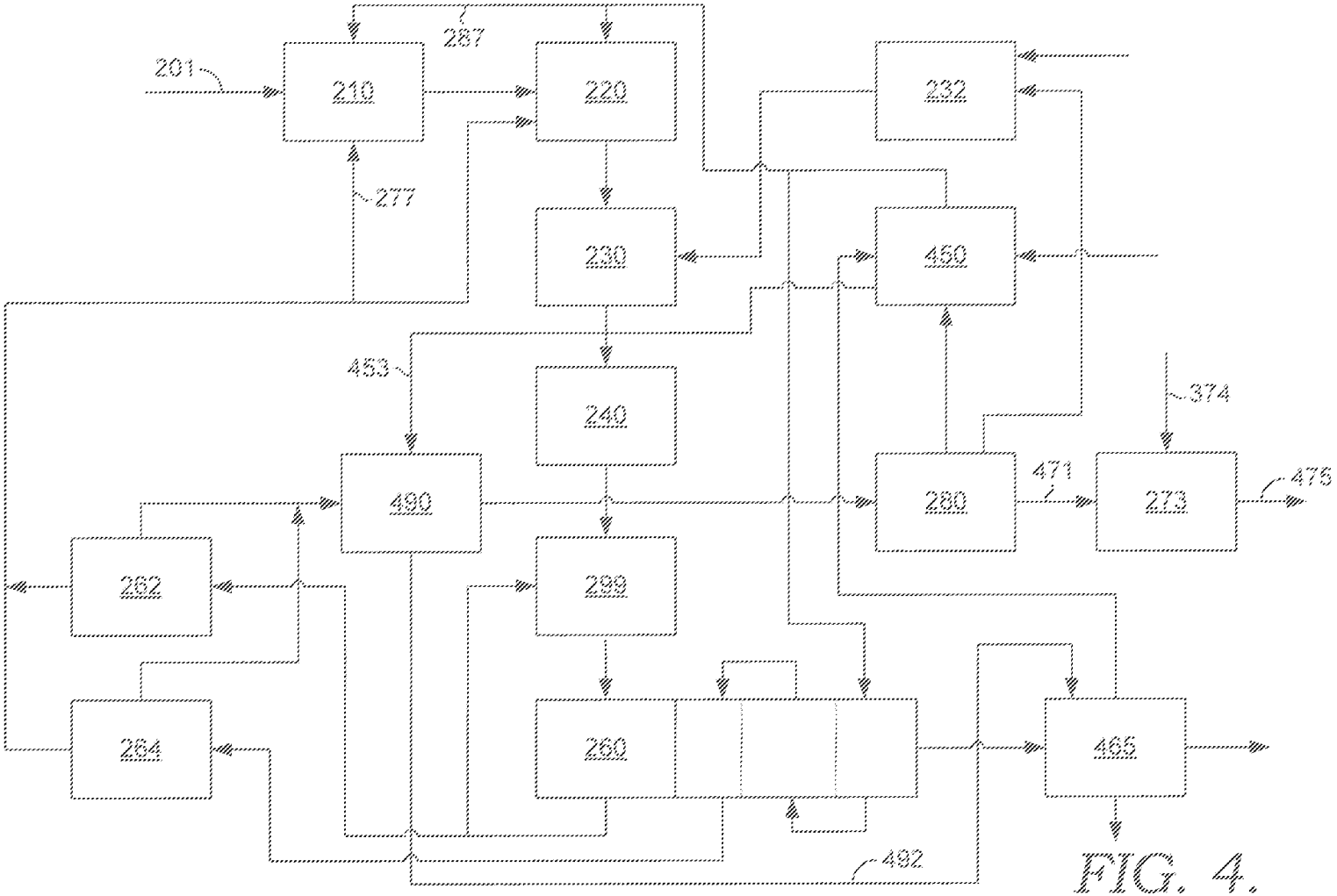
FIG. 4 schematically shows an example of a process flow for using non-aqueous extraction to form a bitumen from oil sands.

FIG. 4 shows an alternative configuration for integrating the electrostatic filtration stage 490 with the non-aqueous extraction system. In FIG. 4, the electrostatic filtration stage 490 is used to remove particles from the bitumen prior to separating the bitumen from the non-aqueous solvent in solvent recovery stage 280. In a configuration similar to FIG. 4, the rich extract 462 and lean extract 464 are passed into the electrostatic filtration stage 490. This can have the advantage of performing the filtration 490 on a lower viscosity fluid, as the combination of extraction solvent and bitumen can typically have a lower viscosity than the bitumen. However, some water can also be retained with the extraction solvent. The increased water content of the solvent and bitumen mixture in the rich extract 462 and lean extract 464 can potentially increase the conductivity of the solvent/bitumen mixture. Thus, configurations similar to FIG. 4 can be used when the solvent/bitumen mixture has a sufficiently low water content. Otherwise, the integration of the electrostatic separation stage 490 in FIG. 4 is similar to FIG. 3. The wash effluent 492 from the electrostatic separation stage 490 is passed into dryer/vapor recovery stage 465. Similarly, after the nitrogen purge, the wash is performed using a non-aqueous solvent stream 453 from solvent tank 450.

ADDITIONAL EMBODIMENTS

Embodiment 1. A method for producing a bitumen product from oil sands, comprising: extracting bitumen from oil sands with a non-aqueous extraction solvent to form a mixture of bitumen and extraction solvent; performing a physical separation on at least a portion of the mixture of bitumen and extraction solvent to form at least a first filtered mixture of bitumen and extraction solvent; separating at least a portion of the first filtered mixture of bitumen and extraction solvent to form a filtered bitumen stream and a filtered extraction solvent stream, the filtered bitumen stream containing at least about 0.25 wt % of non-petroleum particles; and performing an electrostatic separation on at least a portion of the filtered bitumen stream to form a bitumen product containing about 1200 wppm or less of non-petroleum particles, or about 1000 wppm or less, or about 750 wppm or less, or about 500 wppm or less, or about 300 wppm or less.

Embodiment 2. The method of Embodiment 1, wherein performing an electrostatic separation on at least a portion of the filtered bitumen stream comprises: passing the at least a portion of the filtered bitumen stream into a separation volume of an electrostatic separator under effective electrostatic separation conditions, the effective electrostatic separation conditions including maintaining a separation voltage across the separation volume, at least a portion of the separation volume optionally containing a solid dielectric material; purging the separation volume with a purge fluid to form a purged portion of the bitumen product; and washing the separation volume with the extraction solvent, a washing voltage across the separation volume during the washing being less than the separation voltage.

Embodiment 3. The method of Embodiment 2, wherein the performing of the electrostatic separation comprises a cyclic process, a second passing of at least a portion of the filtered bitumen stream being performed after the washing of the separation volume.

Embodiment 4. A method for producing a bitumen product from oil sands, comprising: extracting bitumen from oil sands with a non-aqueous extraction solvent to form a mixture of bitumen and extraction solvent; performing a physical separation on at least a portion of the mixture of bitumen and extraction solvent to form at least a first filtered mixture of bitumen and extraction solvent, the first filtered mixture of bitumen and extraction solvent containing at least about 0.25 wt % of non-petroleum particles; performing an electrostatic separation on at least a portion of the first filtered mixture of bitumen and extraction solvent to form a filtered, separated mixture of bitumen and extraction solvent; and separating at least a portion of the filtered, separated mixture of bitumen and extraction solvent to form a bitumen product and an extraction solvent stream, the bitumen product containing about 1200 wppm or less of non-petroleum particles, or about 1000 wppm or less, or about 750 wppm or less, or about 500 wppm or less, or about 300 wppm or less.

Embodiment 5. The method of Embodiment 4, wherein performing an electrostatic separation on at least a portion of the first filtered mixture of bitumen and extraction solvent comprises: passing the at least a portion of the first filtered mixture of bitumen and extraction solvent into a separation volume of an electrostatic separator under effective electrostatic separation conditions, the effective electrostatic separation conditions including maintaining a separation voltage across the separation volume, at least a portion of the separation volume optionally containing a solid dielectric material; purging the separation volume with a purge fluid to form a purged portion of the filtered, separated mixture of bitumen and extraction solvent; and washing the separation volume with the extraction solvent, a washing voltage across the separation volume during the washing being less than the separation voltage.

Embodiment 6. The method of Embodiment 5, wherein the performing of the electrostatic separation comprises a cyclic process, a second passing of at least a portion of the first filtered mixture of bitumen and extraction solvent being performed after the washing of the separation volume.

Embodiment 7. The method of any of Embodiments 2 to 3 or 5 to 6, the method further comprising removing the extraction solvent from the separation volume after the washing of the separation volume, the removing of the extraction solvent being performed with the purge fluid.

Embodiment 8. The method of any of Embodiments 2 to 3 or 5 to 7, wherein the washing voltage is 0, wherein the washing voltage is a voltage produced by stopping power to at least one electrode associated with the separation volume, or a combination thereof.

Embodiment 9. The method of any of the above embodiments, further comprising adding water to the mixture of bitumen and extraction solvent prior to the performing of the physical separation.

Embodiment 10. The method of any of the above embodiments, wherein the extraction solvent is cyclohexane.

Embodiment 11. The method of any of Embodiments 1 to 9, wherein the extraction solvent comprises a naphtha stream, heptane, other alkanes containing at least 7 carbons, cyclohexane, other cycloalkanes containing at least 6 carbons, aromatics containing a 6 member ring, toluene, or combinations thereof.

Embodiment 12. The method of any of the above embodiments, wherein the bitumen product is diluted with a naphtha boiling range stream, a kerosene boiling range stream, or a combination thereof.

Embodiment 13. The method of any of the above embodiments, wherein the extracting bitumen with the extraction solvent comprises extracting bitumen with a mixture of the extraction solvent and a recycled portion of the first filtered mixture of bitumen and extraction solvent.

Embodiment 14. The method of any of the above embodiments, wherein the filtered bitumen stream or the filtered, separated mixture of bitumen and extraction solvent contains at least about 0.5 wt % of non-petroleum particles, or at least about 1 wt %.

Embodiment 15. The method of any of the above embodiments, further comprising diluting the bitumen product with a diluent, the diluent being different from the extraction solvent.

Embodiment 16. The method of any of the above embodiments, wherein the electrostatic separator is operated at a pressure from about 100 kPaa to about 3500 kPaa, or about 100 kPaa to about 3000 kPaa, or about 100 kPaa to about 2500 kPaa, or about 100 kPaa to about 2000 kPaa, or about 100 kPaa to about 1500 kPaa, or about 100 kPaa to about 1000 kPaa, or about 100 kPaa to about 500 kPaa, or about 250 kPaa to about 3500 kPaa, or about 250 kPaa to about 3000 kPaa, or about 250 kPaa to about 2500 kPaa, or about 250 kPaa to about 2000 kPaa, or about 250 kPaa to about 1500 kPaa, or about 250 kPaa to about 1000 kPaa, or about 250 kPaa to about 500 kPaa, or about 500 kPaa to about 3500 kPaa, or about 500 kPaa to about 3000 kPaa, or about 500 kPaa to about 2500 kPaa, or about 500 kPaa to about 2000 kPaa, or about 500 kPaa to about 1500 kPaa, or about 500 kPaa to about 1000 kPaa.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

What is claimed is:

1. A method for producing a bitumen product from oil sands, comprising:

extracting bitumen from oil sands with a non-aqueous extraction solvent to form a mixture of bitumen and extraction solvent;

performing a physical separation on at least a portion of the mixture of bitumen and extraction solvent to form at least a first filtered mixture of bitumen and extraction solvent;

separating at least a portion of the first filtered mixture of bitumen and extraction solvent to form a filtered bitumen stream and a filtered extraction solvent stream, the filtered bitumen stream containing at least about 0.25 wt % of non-petroleum particles; and performing an electrostatic separation on at least a portion of the filtered bitumen stream to form a bitumen product containing about 1200 wppm or less of non-petroleum particles.

2. The method of claim 1, wherein performing an electrostatic separation on at least a portion of the filtered bitumen stream comprises:

passing the at least a portion of the filtered bitumen stream into a separation volume of an electrostatic separator under effective electrostatic separation conditions, the effective electrostatic separation conditions including maintaining a separation voltage across the separation volume;

purging the separation volume with a purge fluid to form a purged portion of the bitumen product; and washing the separation volume with the extraction solvent, a washing voltage across the separation volume during the washing being less than the separation voltage.

3. The method of claim 2, wherein the performing of the electrostatic separation comprises a cyclic process, a second passing of at least a portion of the filtered bitumen stream being performed after the washing of the separation volume.

4. The method of claim 2, the method further comprising removing the extraction solvent from the separation volume after the washing of the separation volume, the removing of the extraction solvent being performed with the purge fluid.

5. The method of claim 2, wherein the washing voltage is 0, the washing voltage is a voltage produced by stopping power to at least one electrode associated with the separation volume, or a combination thereof.

6. The method of claim 2, wherein at least a portion of the separation volume contains a solid dielectric material.

7. The method of claim 1, further comprising diluting the bitumen product with a diluent, the diluent being different from the extraction solvent.

8. The method of claim 1, further comprising adding water to the mixture of bitumen and extraction solvent prior to the performing of the physical separation.

9. The method of claim 1, wherein the extraction solvent is cyclohexane.

10. The method of claim 1, wherein the bitumen product is diluted with a naphtha boiling range stream, a kerosene boiling range stream, or a combination thereof.

11. The method of claim 1, wherein the filtered bitumen stream contains at least about 0.5 wt % of non-petroleum particles, or at least about 1 wt %.

12. The method of claim 1, wherein the extracting bitumen with the extraction solvent comprises extracting bitumen with a mixture of the extraction solvent and a recycled portion of the filtered bitumen stream.

13. The method of claim 1, wherein the extracting bitumen with the extraction solvent comprises extracting bitumen with a mixture of the extraction solvent and a recycled portion of the first filtered mixture of bitumen and extraction solvent.

14. A method for producing a bitumen product from oil sands, comprising:

extracting bitumen from oil sands with a non-aqueous extraction solvent to form a mixture of bitumen and extraction solvent;

performing a physical separation on at least a portion of the mixture of bitumen and extraction solvent to form at least a first filtered mixture of bitumen and extraction solvent, the first filtered mixture of bitumen and extraction solvent containing at least about 0.25 wt % of non-petroleum particles;

performing an electrostatic separation on at least a portion of the first filtered mixture of bitumen and extraction solvent to form a filtered, separated mixture of bitumen and extraction solvent; and separating at least a portion of the filtered, separated mixture of bitumen and extraction solvent to form a bitumen product and an extraction solvent stream, the bitumen product containing about 1200 wppm or less of non-petroleum particles.

15. The method of claim 14, wherein performing an electrostatic separation on at least a portion of the first filtered mixture of bitumen and extraction solvent comprises:

passing the at least a portion of the first filtered mixture of bitumen and extraction solvent into a separation volume of an electrostatic separator under effective electrostatic separation conditions, the effective electrostatic separation conditions including maintaining a separation voltage across the separation volume;

purging the separation volume with a purge fluid to form a purged portion of the filtered, separated mixture of bitumen and extraction solvent; and washing the separation volume with the extraction solvent, a washing voltage across the separation volume during the washing being less than the separation voltage.

16. The method of claim 15, wherein the performing of the electrostatic separation comprises a cyclic process, a second passing of at least a portion of the first filtered mixture of bitumen and extraction solvent being performed after the washing of the separation volume.

17. The method of claim 15, the method further comprising removing the extraction solvent from the separation volume after the washing of the separation volume, the removing of the extraction solvent being performed with the purge fluid.

18. The method of claim 15, wherein the washing voltage is 0, the washing voltage is a voltage produced by stopping power to at least one electrode associated with the separation volume, or a combination thereof.

19. The method of claim 14, wherein the extracting bitumen with the extraction solvent comprises extracting bitumen with a mixture of the extraction solvent and a recycled portion of the first filtered mixture of bitumen and extraction solvent.

20. The method of claim 14, further comprising diluting the bitumen product with a diluent, the diluent being different from the extraction solvent.

* * * * *